US006251051B1

(12) United States Patent
Chen

(10) Patent No.: US 6,251,051 B1
(45) Date of Patent: Jun. 26, 2001

(54) PUNCHING AID

(76) Inventor: Sherry Chen, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/432,065

(22) Filed: Oct. 27, 1999

(51) Int. Cl.[7] ..... A63B 69/00
(52) U.S. Cl. ..... 482/83; 482/87; 482/90; 472/441; 472/445
(58) Field of Search ..... 482/83–90, 900

(56) References Cited

U.S. PATENT DOCUMENTS 4,486,016 * 12/1984 Rubin ..... 482/87
4,662,630 * 5/1987 Dignard et al. ..... 482/87
5,330,403 7/1994 Kuo ..... 482/83
5,624,358 * 4/1997 Hestilow ..... 482/87
5,921,895 * 7/1999 Lynch et al. ..... 482/87

* cited by examiner

*Primary Examiner*—Jerome W. Donnelly
(74) *Attorney, Agent, or Firm*—Charles E. Baxley

(57) ABSTRACT

A punching aid includes a column disposed above a base, a pad adjustably attached onto the column, and a flexible device secured between the base and the column to provide a flexibility to the column relative to the base. The flexible device includes two couplers secured to the ends. The base and the column each includes a stud engaged into and secured to the couplers for securing the flexible device between the column and the base. The couplers each has a protrusion and a disc engaged into the flexible device for solidly securing the flexible device to the base and the column.

15 Claims, 6 Drawing Sheets

PUNCHING AID

BACKGROUND OF THE INVENTION

1. Field of the Invention

The present invention relates to a punching aid, and more particularly to a punching aid for home use.

2. Description of the Prior Art

U.S. Pat. No. 4,486,016 to Rubin discloses a typical punching bag support including a flexible support rod having a lower portion engaged into a base support and detachably secured to the base support with fasteners. The support rod may not be easily bent during punching operations.

U.S. Pat. No. 5,330,403 to Kuo discloses another punching device including a support rod having a lower portion squeezed and engaged into a base support, and a spring engaged on the squeezed portion of the support rod for forming a flexible punching device. The spring may not be coupled between the support rod and the base without the squeezed portion of the support rod, and the squeezed portion of the support rod may be easily broken while or after punching.

U.S. Pat. No. 5,624,358 to Hestilow discloses a further punching device including a column extended upward from a pedestal and formed integral as an integral one piece unit. The column is solidly secured to or extended from the pedestal such that the column may not be easily bent while punching. In addition, the punching device occupies a great volume which is adverse for transportation and carrying purposes.

The present invention has arisen to mitigate and/or obviate the afore-described disadvantages of the conventional punching or boxing aids.

SUMMARY OF THE INVENTION

The primary objective of the present invention is to provide a punching aid including a flexible structure for facilitating the punching or boxing exercises.

The other objective of the present invention is to provide a punching aid including a detachable structure for allowing the punching aid to be disassembled and packaged to a compact configuration.

In accordance with one aspect of the invention, there is provided a punching aid comprising a base, a column provided above the base, a pad attached onto the column, a flexible device, and means for securing the flexible device between the base and the column to provide a flexibility to the column relative to the base.

The flexible device includes a lower portion and an upper portion, the securing means includes means for fastening the lower portion of the flexible device to the base and means for fastening the upper portion of the flexible device to the column. The pad may be adjusted relative to the column according to the sizes of the users.

The flexible device includes a first end, the securing means includes a first coupler provided on the first end of the flexible device, a second coupler provided on the base, and means for locking the second coupler and the first coupler together. The second coupler is a stud extended from the base and having a groove formed therein, the first coupler includes a hole formed therein for receiving the stud of the base. The locking means includes a projection extended inward of the hole of the first coupler and engaged into the groove of the stud. The stud further includes a lock slot formed therein and communicating with the groove of the stud for receiving the projection of the first coupler.

The locking means includes a fastener engaged through the second coupler and the first coupler to secure the second coupler and the first coupler together. The first coupler includes a protrusion extended therefrom and engaged into the first end of the flexible device. The first coupler includes a disc secured on the protrusion and engaged in the first end of the flexible device. The disc includes at least one opening formed therein for receiving a material for forming the flexible device.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
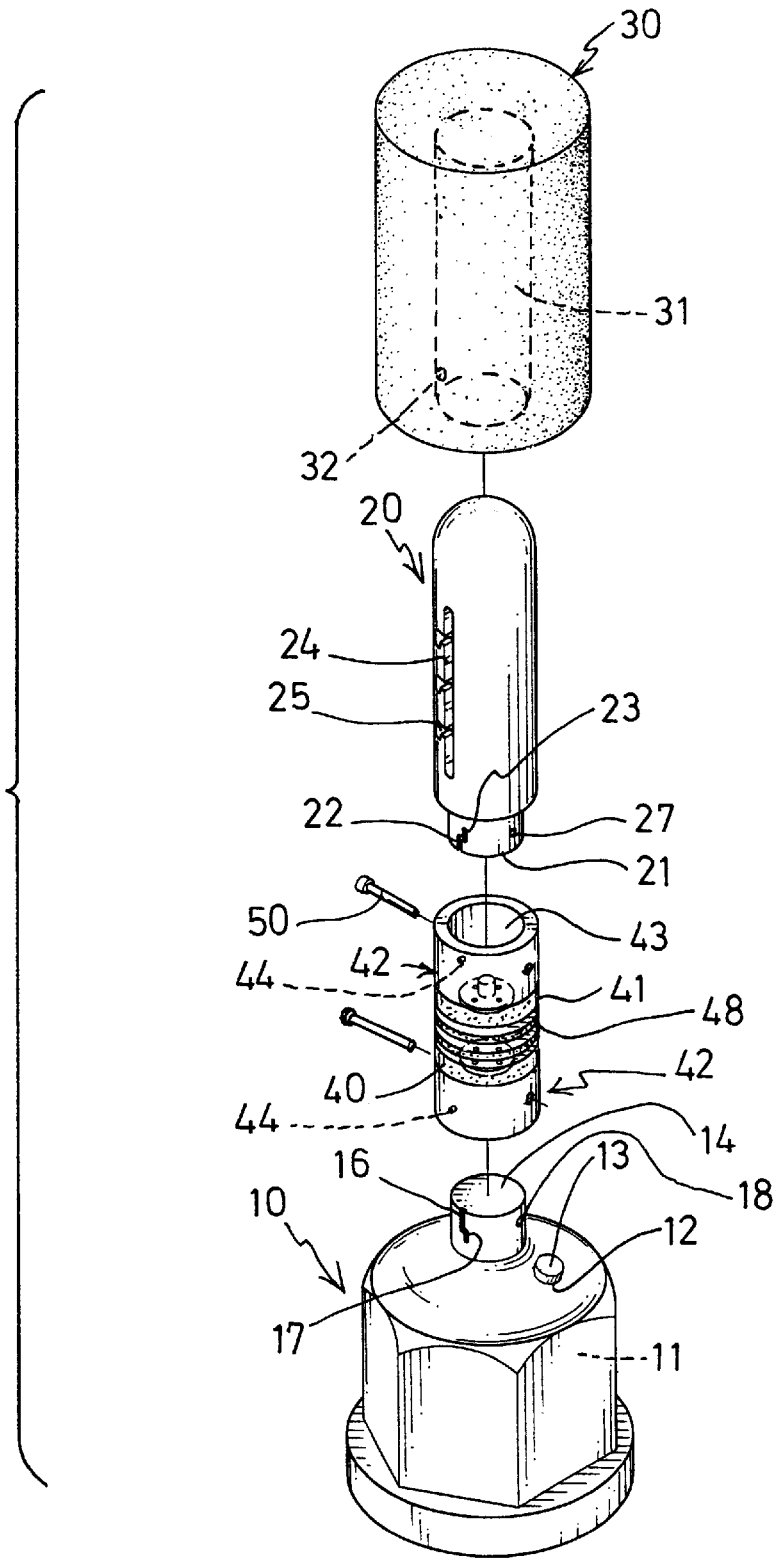
FIG. 1 is an exploded view of a punching aid in accordance with the present invention.
Figure 2:
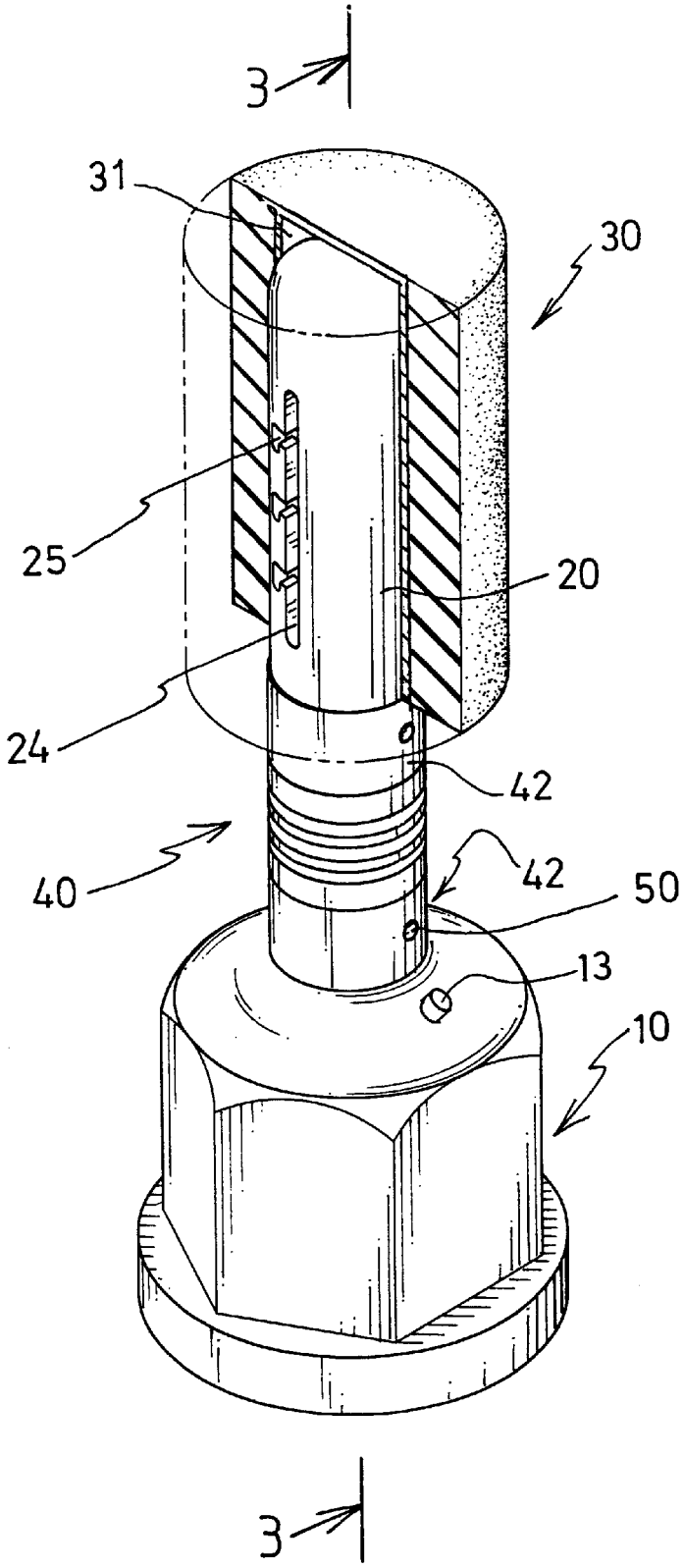
FIG. 2 is a perspective view of the punching aid, in which a portion of the cover is cut off.
Figure 3:
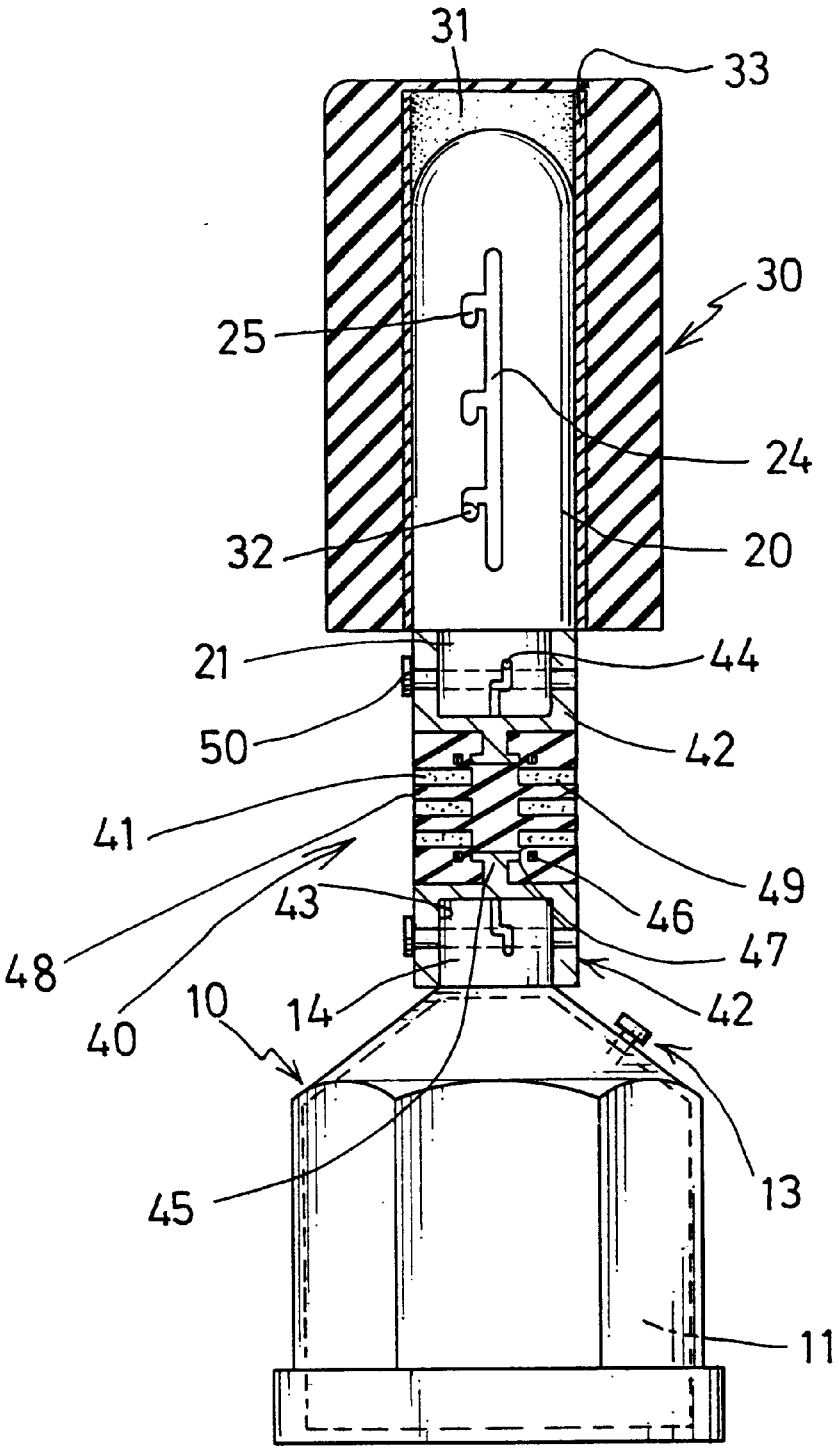
FIG. 3 is a cross sectional view taken along lines 3—3 of FIG. 2.

Referring to the drawings, and initially to FIGS. 1–3, a punching aid in accordance with the present invention comprises a base 10 including a chamber 11 formed therein for receiving fluids and including a mouth 12 formed in the upper portion thereof and communicating with the chamber 11 of the base 10 for receiving the fluids, such as the water, any suitable liquid, or other particulate materials, such as sand, gravel, coated or uncoated metallic shot and the like, to give the punching aid stability. A cap 13 is detachably secured onto the mouth 12 of the base 10 for enclosing the chamber 11 of the base 11 and for confining the fluids within the base 10. The base 10 includes a coupler, such as a stud 14 extended upward therefrom and having one or more, preferably two, grooves 16 formed therein. The grooves 16 have an open upper end and is preferably vertical and have a lock slot 17 formed in the lower portion thereof. The stud 14 includes an aperture 18 formed therein for threading a fastener or a pin 50. The base 10 may also be made to a solid structure having a suitable stability.

Figure 4:
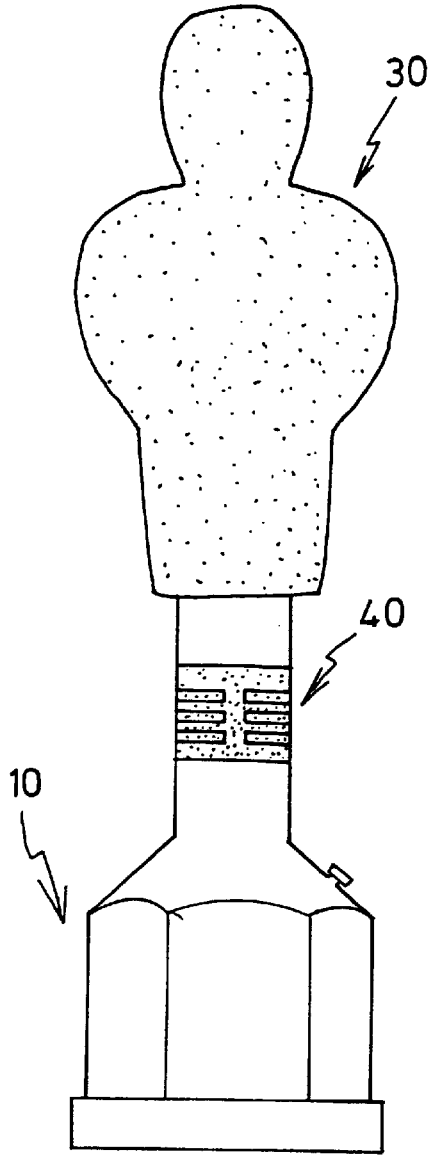
FIG. 4 is a plane view of the punching aid.

A column 20 is to be secured vertically on top of the base 10 and includes a coupler, such as a stud 21 provided on the lower portion thereof. The stud 21 is similar to the stud 14 of the base 10 and includes one or more, preferably two, grooves 22 formed therein. The grooves 22 have an open lower end and is preferably vertical and have a lock slot 23 formed in the upper portion thereof. The stud 21 includes an aperture 27 formed therein for threading a fastener or a pin 50. The column 20 includes one or more longitudinal channels 24 formed therein and having one or more lock slots 25 communicating with the respective channels 24. A striking pad 30 includes a bore 31 formed therein for receiving the column 20 and includes one or more projections 32 extended inward of the bore 31 thereof for engaging into the channels 24 and/or the lock slots 25 of the column 20 and for setting the pad 30 to various heights. The pad 30 is preferably made of spongy or rubber materials for striking purposes, and may be formed into various kinds of shapes, such as a human body shape (FIG. 4) or a cylindrical shape (FIGS. 1–3). The pad 30 preferably may include an enclosed (FIGS. 1–3) or open (FIGS. 5–7) upper portion. As best shown in FIGS. 2 and 3, a barrel 33 is preferably engaged in and secured in the inner portion of the pad 30 for defining the bore 31 of the pad 30 and is made of harder or stronger materials than that for the pad 30, such as plastic materials, and has the projections 32 extended therefrom. The projections 32 are also made of the stronger materials and thus have a suitable strength for engaging into the channels 24 and the lock slots 25 of the column 20 and for supporting the pad 30 on the column 20 at the required height.

A flexible device 40 includes two couplers 42 secured to the ends thereof, such as the upper and the lower ends thereof for securing or fastening or locking onto the studs 14, 21 of the base 10 and the column 20 and for providing a flexibility to the column 20 relative to the base 10. The couplers 42 each includes a hole 43 formed therein for receiving the respective stud 14, 21 and each includes a projection 44 extended inward of the hole 43 thereof for engaging into the grooves 16, 22 and the lock slots 17, 23 of the studs 14, 21 and for securing the flexible device 40 between the base 10 and the column 20. The pins 50 may be engaged through the couplers 42 and the studs 14, 21 for further solidly securing the flexible device 40 between the base 10 and the column 20. The flexible device 40 is preferably made of synthetic or rubber materials and may be made to a size or a diameter no less than that of the column 20. However, if the material is strong enough, the flexible device 40 may be made to a smaller size than that of the column 20. The flexible device 40 may further include one or more peripheral or annular grooves 41 formed therein for defining one or more peripheral ribs 48 and for increasing the flexibility to the flexible device 40, and may include one or more fins 49 formed in the annular grooves 41 and coupled between the ribs 48 for increasing the strength of the flexible device 40.

As best shown in FIG. 3, the couplers 42 each includes a protrusion 45 extended inward of the flexible device 40 and a disc 46 formed or provided on the end portion of the protrusion 45. The protrusion 45 and the disc 46 of each coupler 42 may be engaged in the flexible device 40 when molding the flexible device 40 onto the couplers 42 such that the flexible device 40 may be solidly secured to the couplers 42. The discs 46 may each further include one or more openings 47 formed therein. The material for forming the flexible device 40 may be engaged into the openings 47 of the discs 46 while molding the flexible device 40 onto the couplers 42 such that the flexible device 40 may further be solidly secured to the couplers 42.

The most important characteristic for the punching aid is that the flexible device 40 has the tipper and the lower portions coupled to the column 20 and the base 10 respectively. None of the arts may provide a flexible device 40 directly coupled to the base 10 and the column 20. Although the flexible device 40 is shown to be coupled to the base 10 and the column 20 with the engagement between the stud and the coupler, the flexible device 40 may also be directly coupled to the base and the column with fasteners without the studs and the couplers. The column 20 and the pad 30 and/or the flexible device 40 may be detached or disengaged from the base 10 such that the column of the punching aid may be greatly decreased for facilitating the storing and the transportation thereof.

Figure 5:
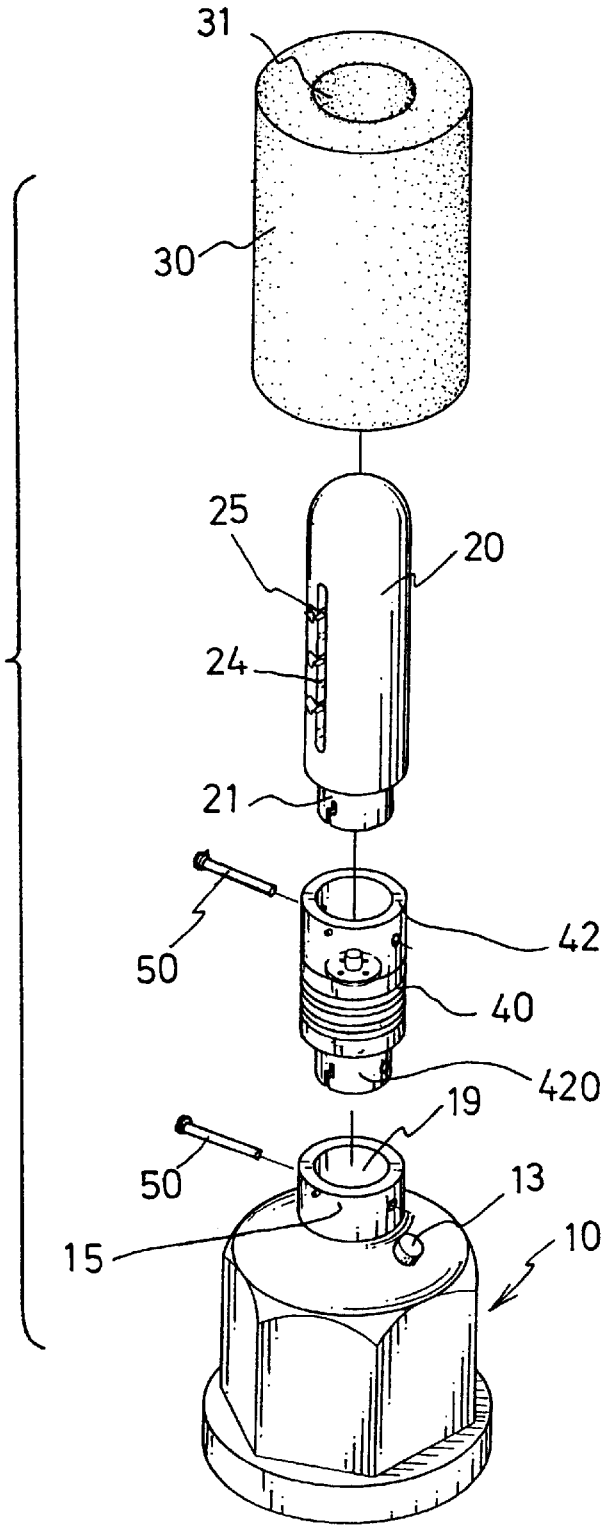
FIG. 5 is an exploded view illustrating the other application of the punching aid.
Figure 6:
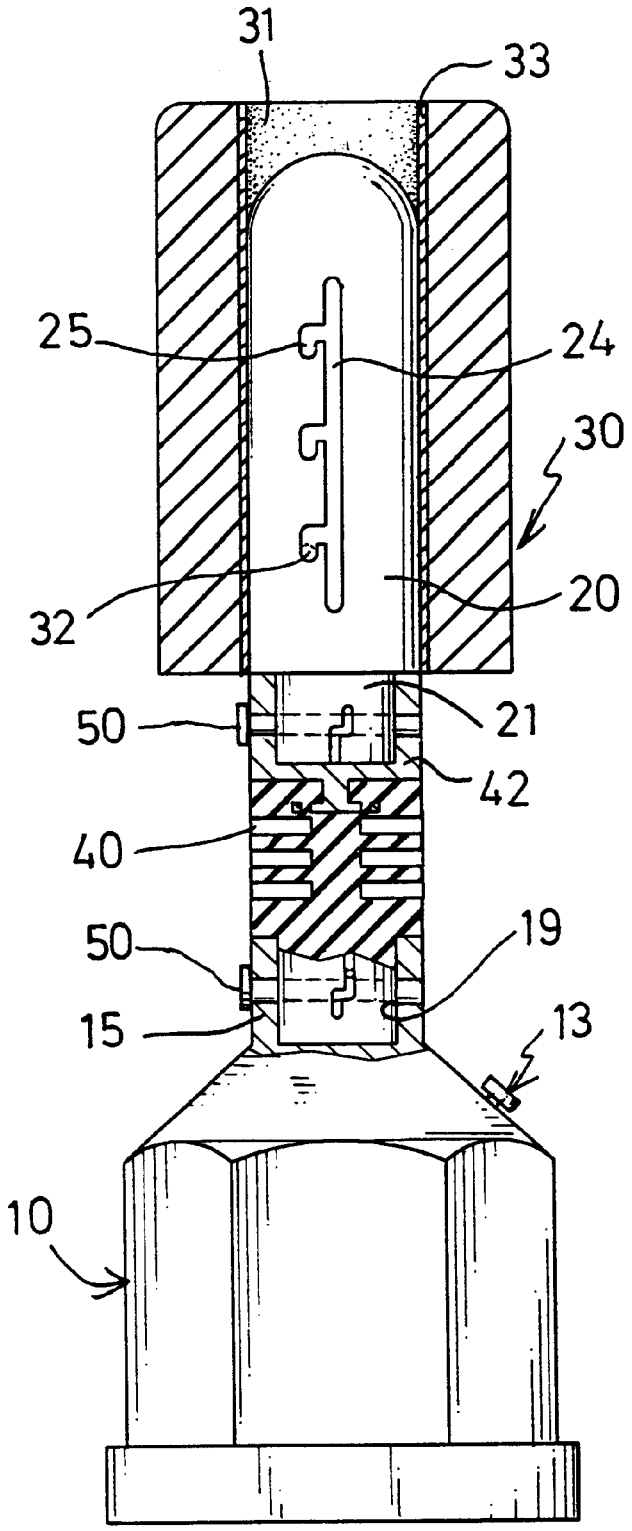
FIG. 6 is a cross sectional view of the punching aid as shown in FIG. 5.
Figure 7:
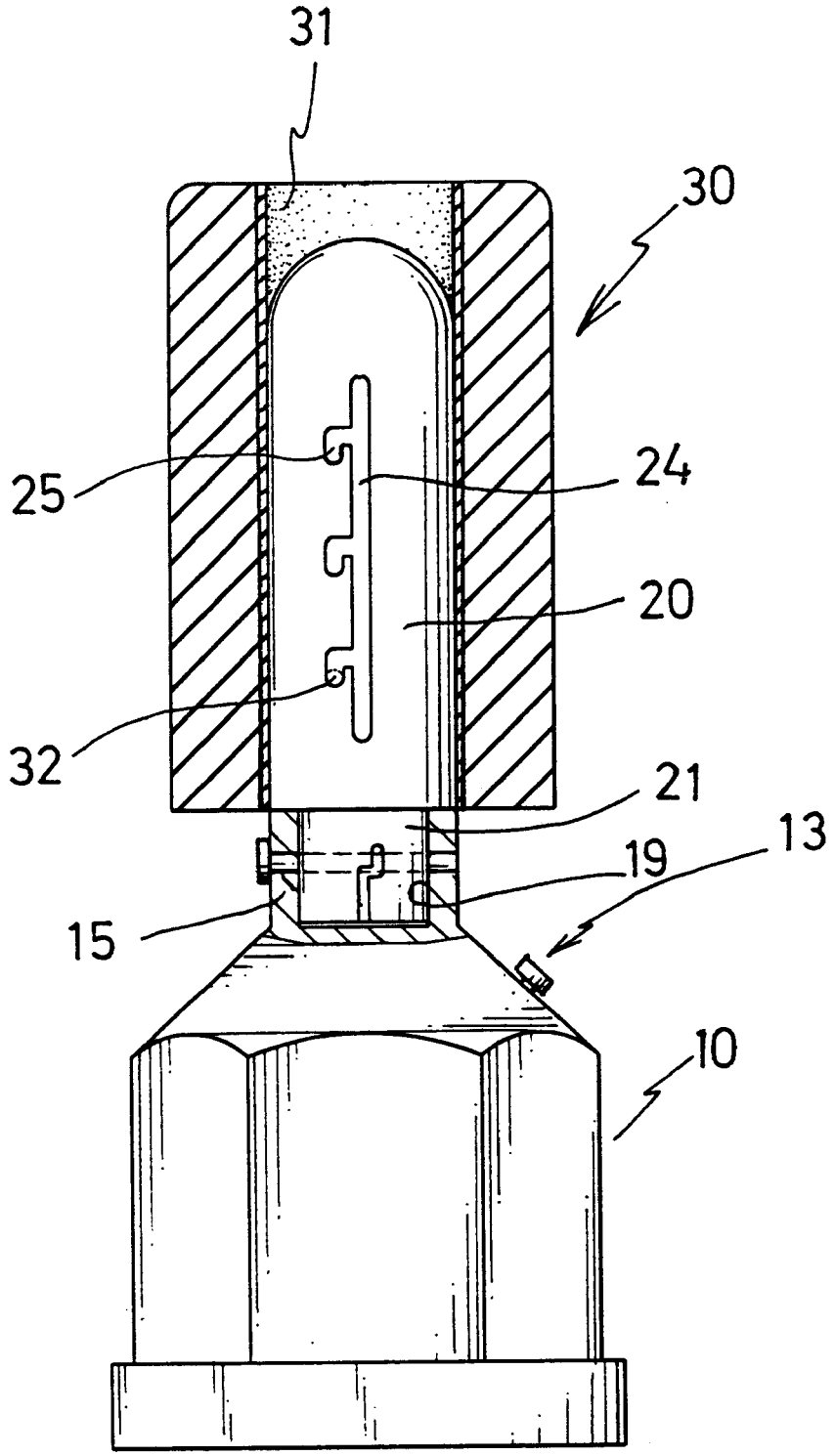
FIG. 7 is a cross sectional view illustrating the application of the punching aid as shown in FIGS. 5 and 6.

Referring next to FIGS. 5 and 6, one of the couplers 420 secured to the flexible device 40 may be a stud-shaped coupler 420 (FIG. 5) similar to that (14, 21) of the base 10 and the column 20. The column 20 or the base 10 may include a socket 100 similar to the couplers 42 as shown in FIGS. 1–3 and having a hole 19 formed therein for receiving the stud-shaped coupler 420 which may also be secured to the socket 100 with a projection-lock slot engagement and/or a locking pin. As shown in FIG. 7, the socket or the stud 21 of the column 20 may be directly secured to the stud or the socket 15 of the base 10 without the flexible device 40 for decreasing the height of the punching aid and for being easily stricken by the children.

Accordingly, the punching aid in accordance with the present invention includes a flexible structure for facilitating the punching or boxing exercises, and includes a detachable structure for allowing the punching aid to be disassembled and packaged to a compact configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A punching aid comprising:

a base, a column provided above said base, a pad attached onto said column, a flexible device including a first end, and means for securing said flexible device between said base and said column to provide a flexibility to said column relative to said base, said securing means including a first coupler Provided on said first end of said flexible device, a second coupler being a stud extended from said base and having a groove formed therein, said first coupler including a hole formed therein for receiving said stud of said base, and means for locking said second coupler and said first coupler together, wherein said locking means includes a projection extended inward of said hole of said first coupler and engaged into said groove of said stud.

2. The punching aid according to claim 1, wherein said stud further includes a lock slot formed therein and communicating with said groove of said stud for receiving said projection of said first coupler.

3. The punching aid according to claim 1, wherein said locking means includes a fastener engaged through said second coupler and said first coupler to secure said second coupler and said first coupler together.

4. A punching aid comprising:

a base, a column provided above said base, a pad attached onto said column, a flexible device including a first end, and means for securing said flexible device between said base and said column to provide a flexibility to said column relative to said base, said securing means including a first coupler provided on said first end of said flexible device, a second coupler provided on said base, and means for locking said second coupler and said first coupler together, wherein said first coupler includes a protrusion extended therefrom and engaged into said first end of said flexible device.

5. The punching aid according to claim 4, wherein said first coupler includes a disc secured on said protrusion and engaged in said first end of said flexible device.

6. The punching aid according to claim 5, wherein said disc includes at least one opening formed therein for receiving a material for forming said flexible device.

7. A punching aid comprising:

a base, a column provided above said base, a pad attached onto said column, a flexible device, and means for securing said flexible device between said base and said column to provide a flexibility to said column relative to said base, wherein said flexible device includes a first end, said securing means includes a first coupler provided on said first end of said flexible device, a second coupler provided on said column, and means for locking said second coupler and said first coupler together.

8. The punching aid according to claim 7, wherein said second coupler is a stud extended from said column and having a groove formed therein, said first coupler includes a hole formed therein for receiving said stud of said column.

9. The punching aid according to claim 8, wherein said said locking means includes a projection extended inward of said hole of said first coupler and engaged into said groove of said stud.

10. The punching aid according to claim 9, wherein said stud further includes a lock slot formed therein and communicating with said groove of said stud for receiving said projection of said first coupler.

11. The punching aid according to claim 7, wherein said locking means includes a fastener engaged through said second coupler and said first coupler to secure said second coupler and said first coupler together.

12. The punching aid according to claim 7, wherein said first coupler includes a protrusion extended therefrom and engaged into said first end of said flexible device.

13. The punching aid according to claim 12, wherein said first coupler includes a disc secured on said protrusion and engaged in said first end of said flexible device.

14. The punching aid according to claim 13, wherein said disc includes at least one opening formed therein for receiving a material for forming said flexible device.

15. A punching aid comprising:

a base, a column provided above said base, a pad attached onto said column, a flexible device, means for securing said flexible device between said base and said column to provide a flexibility to said column relative to said bases, and means for adjusting said pad relative to said column.

* * * * *